United States Patent [19]

Suzuki

[11] 4,245,677

[45] Jan. 20, 1981

[54] METHOD AND APPARATUS FOR SUPPLYING TRANSPORT FLUID TO AUXILIARY JET NOZZLES IN A JET LOOM

[75] Inventor: Hajime Suzuki, Anjyo, Japan

[73] Assignee: Kabushiki Kaisha Toyoda Jidoshokki Seisakusho, Kariya, Japan

[21] Appl. No.: 9,734

[22] Filed: Feb. 5, 1979

[30] Foreign Application Priority Data

Feb. 10, 1978 [JP] Japan ..... 53-14447

[51] Int. Cl.[3] ..... D03D 47/30

[52] U.S. Cl. ..... 139/435

[58] Field of Search ..... 139/435; 226/95, 97

[56] References Cited

U.S. PATENT DOCUMENTS

| | | | |
|---|---|---|---|
| 3,229,725 | 1/1966 | Saito | 139/435 |
| 3,705,608 | 12/1972 | Vermeulen | 139/435 |
| 3,821,972 | 7/1974 | Svaty et al. | 139/435 |
| 4,020,887 | 5/1977 | Spisiak et al. | 139/435 |
| 4,143,681 | 3/1979 | Kuda et al. | 139/435 |

*Primary Examiner*—Henry Jaudon

*Attorney, Agent, or Firm*—Wenderoth, Lind & Ponack

[57] ABSTRACT

A jet loom includes a main jet nozzle for launching a weft thread into a shed, and a plurality of auxiliary jet nozzles successively operated to assist the weft in being transported through the shed by the jet of air injected from the main jet nozzle. The auxiliary jet nozzles are operated to simultaneously discharge the air at least one or more times during a period of time necessary to complete one weft inserting operation.

8 Claims, 10 Drawing Figures

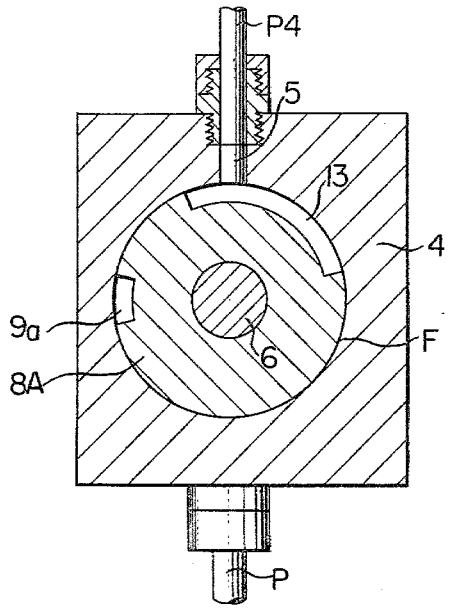
FIG. 4
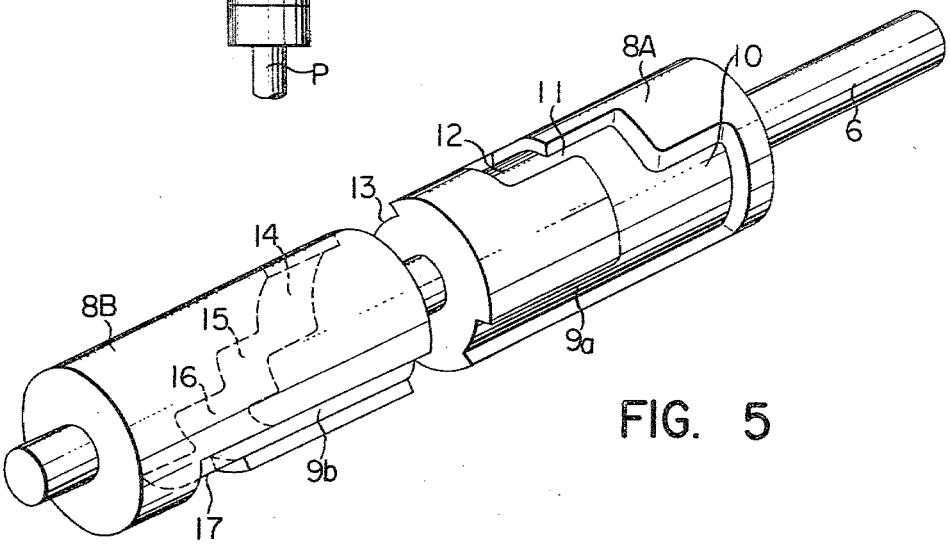
FIG. 5
FIG. 6
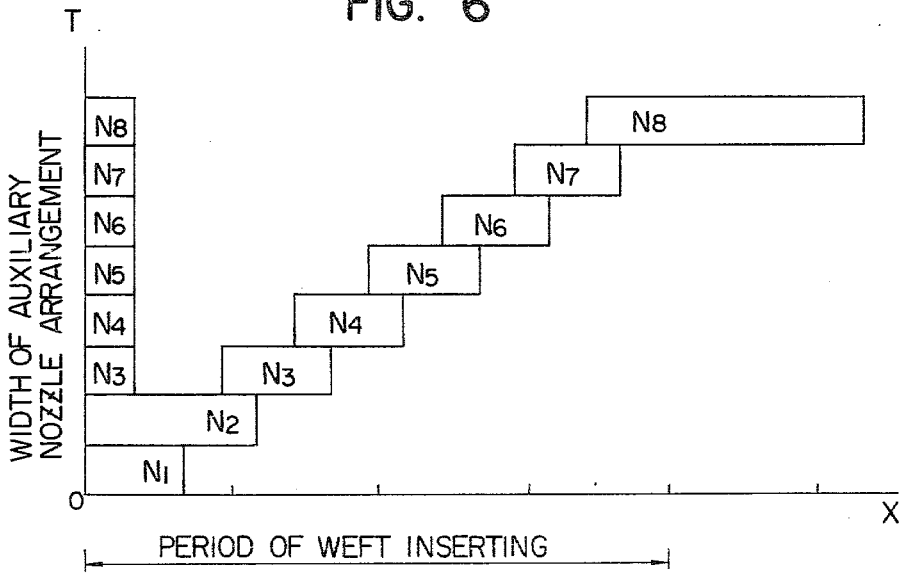

METHOD AND APPARATUS FOR SUPPLYING TRANSPORT FLUID TO AUXILIARY JET NOZZLES IN A JET LOOM

BACKGROUND OF THE INVENTION

This invention relates to a method and apparatus for supplying a transport fluid to auxiliary jet nozzles in a jet loom, wherein a weft thread is inserted into a weaving shed by using the jet of supplied fluid under pressure.

Generally, in a jet loom of such type, a main jet nozzle alone can not transport the leading end of the weft to a distance at a sufficient speed, so that a suitable number of auxiliary jet nozzles are provided on a reed to each produce a flow of air in cooperation with the main jet nozzle. However, if all the auxiliary nozzles are always operated, a large total consumption of air results. In order to reduce the total consumption, U.S. Pat. No. 3,705,608 has proposed to energize the auxiliary jet nozzles successively or in successive groups in time with the advancement of the leading end of the weft through the shed by providing each auxiliary nozzle or each group of auxiliary nozzles with a control device for opening and closing the corresponding nozzle or group of nozzles.

However, the auxiliary jet nozzles or groups of auxiliary jet nozzles are adapted to be operated successively in synchronism with a weaving motion of the loom. Therefore, when the loom is operated at a low speed or in one picking motion, the injection timing of the auxiliary nozzles is delayed with respect to the advancement of the leading end of the weft because at that time the weft is directed into the shed by the main jet nozzle at the same high speed as the normal operation. This causes a poor injection function of the auxiliary jet nozzles, which in turn causes the speed of the weft leading end to be expeditiously reduced to null and the weft leading end to be caught by an auxiliary jet nozzle, resulting in the weft not being inserted.

It is therefore a principal object of this invention to provide a method and apparatus for supplying a transport fluid to auxiliary jet nozzles in a jet loom, which assure that a weft insertion operation can be carried out without any miss even when the jet loom is being operated at a low speed or in one picking motion.

SUMMARY OF THE INVENTION

With the above object in view, this invention resides in a method for supplying a transport fluid to a plurality of auxiliary jet nozzles, which successively discharge the suplied fluid to assist a weft thread launched by a main jet nozzle in being transported through a shed, characterized in that the auxiliary jet nozzles discharge the supplied fluid simultaneously at least one or more times during a period of time necessary to complete one weft inserting operation.

The invention further resides in an apparatus for supplying a transport fluid to a plurality of auxiliary jet nozzles, comprising a first air supply mechanism for successively discharging the supplied fluid to assist a weft thread launched by a main jet nozzle in being transported through a shed, characterized in that the apparatus comprises a second air supply mechanism for allowing the auxiliary jet nozzles to discharge the supplied fluid at the same time.

BRIEF DESCRIPTION OF THE DRAWINGS

This invention will become more readily apparent from the following description of the preferred embodiments thereof shown, by way of example only, in the accompanying drawings in which:

FIG. 4 is a cross section taken on the line IV—IV of FIG. 3;

FIG. 5 is a perspective view of a control valve spool employed in the apparatus of FIG. 3;

FIG. 6 is a diagram explaining a the timing of the operation of auxiliary jet nozzles established in accordance with the air supply method of the invention;

DETAILED DESCRIPTION OF THE EMBODIMENTS

Figure 1:
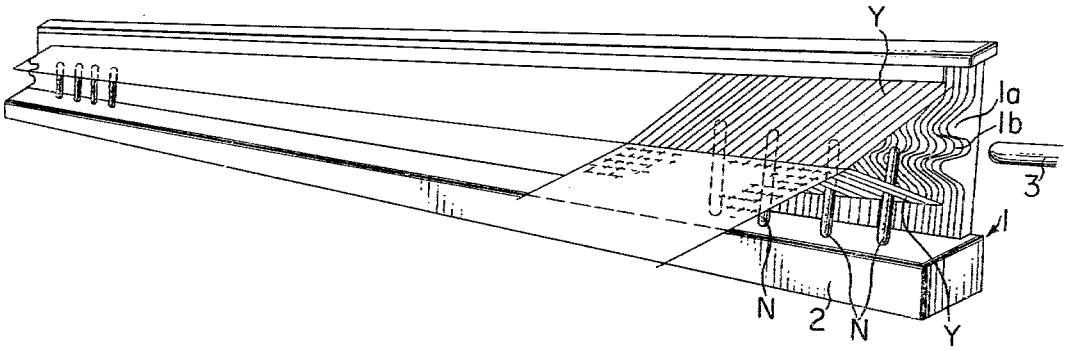
FIG. 1 is a perspective view of a weaving reed to which this invention is applicable.
Figure 2:
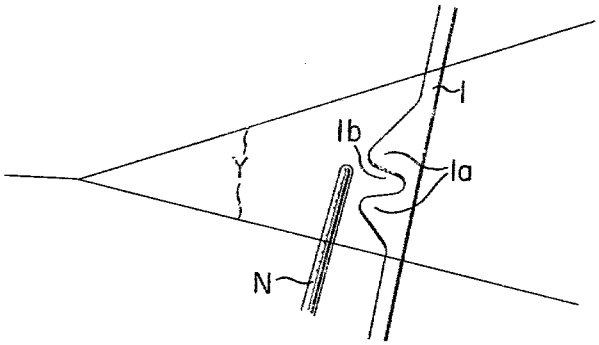
FIG. 2 is a diagrammatic view of the reed looking toward the left in FIG. 1.

Referring now to the drawings, particularly to FIGS. 1 and 2, there is shown a reed 1 having a plurality of equi-spaced guide plates 1*a* perpendicularly mounted on a reed frame 2. Disposed adjacent the endmost guide plates 1*a* is a main jet nozzle 3, which may be connected to a supply of pressurized air (not shown) and discharges a jet of air under high pressure to transport a weft thread, which has been threaded into the main jet nozzle 3, through a shed defined by upper and lower warp sheets Y and the reed 1. The reed frame 2 also has mounted perpendicularly thereon a plurality of equi-spaced auxiliary jet nozzles N, each of the auxiliary jet nozzles N being constructed and arranged in a conventional manner so that the upper end portion thereof is positioned adjacent a guide path 1*b* formed by the guide plates 1*a*, thereby allowing the jet of air under pressure discharged therefrom in the direction, in which the weft is to be transported, to assist the weft in being transported through the guide path 1*b*.

Although a jet loom is generally provided with ten or more auxiliary jet nozzles, the method and apparatus according to this invention will be described, only by way of example, with reference to embodiments employing eight auxiliary jet nozzles N1 to N8.

Figure 3:
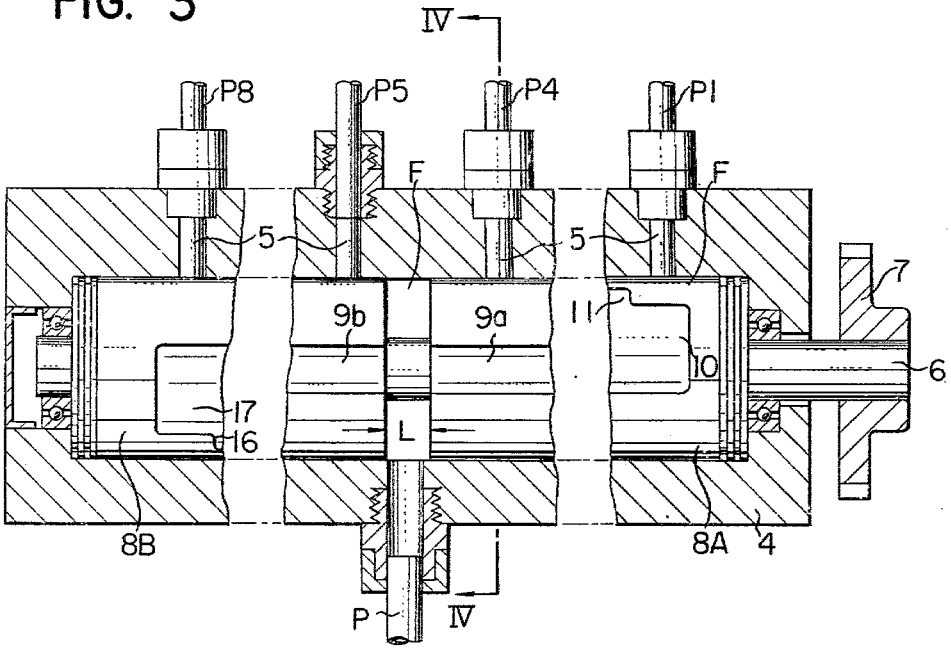
FIG. 3 is a longitudinal sectional view of an air supply apparatus according to the invention.

In FIGS. 3 and 4, a valve apparatus for supplying pressure air to the jet nozzles N1~N8 comprises a casing 4 of a rectangular column-like shape, which defines a cylindrical distributing chamber F extending axially of the casing 4, securely mounted on a suitable portion of the loom. A piping P is sealingly connected to the bottom of the distributing chamber F in a conventional manner as shown in the drawing so that pressure air can be supplied into the distributing chamber F. Eight axially spaced passages 5 (only four are shown in the figure) are also provided in the upper portion of the casing 4 in fluid communication with the distributing chamber F. To the outer ends of these passages 5 are sealingly connected pipings P1~P8, each of which is in turn connected to a corresponding one of the auxiliary jet nozzles N1~N8.

A rotary spindle 6, extending axially into the distributing chamber F, is supported by bearings at the opposed ends of the casing 4 and is provided at its outer end with a gear 7, which is adapted to be driven at a speed in synchronism with the weaving motion of the loom.

As best shown in FIG. 5, a pair of substantially cylindrical valve spools 8A, 8B are fixed onto the rotary spindle 6. When such an assembly consisting of the rotary spindle and the valve spools is positioned in the casing 4, one valve spool 8A is sealingly, rotatably fitted into the substantially right-hand half of the distributing chamber F and the other valve spool 8B into the substantially left-hand half of the same. The valve spools 8A, 8B are spaced from each other by a distance L to provide a space into which the compressed air is injected from piping P.

In the cylindrical surfaces of the valve spools 8A, 8B are provided air distributing pits or grooves 9*a*, 9*b* extending parallel to the axis of the spindle from the inner ends of the spools 8A, 8B to positions adjacent the outer ends of the same so that the pits are in fluid communication with the space defined by the inner ends of the spools. When the valve spools 8A, 8B rotate to locate the air distributing pits 9*a*, 9*b* in the upper area of the chamber F, the pits 9*a*, 9*b* are brought into communication with all of the passages 5. This allows the compressed air supplied into the space defined between the valve spools 8A, 8B to be fed through the passages 5 and the pipings P1~P8 into the auxiliary jet nozzles N1~N8 at the same time. Thus, the pits 9*a*, 9*b* serve to supply the compressed air to all the auxiliary jet nozzles simultaneously.

The air distributing pit 9*a* is connected with first to fourth air supply pits or grooves 10~13 provided in the cylindrical surface of the valve spool 8A. The first to fourth pits 10~13 are arranged so as to correspond in axial position to the first to fourth pipings P1~P4, respectively. The first pit 10 extends from the pit 9*a* in the circumferential direction so that the compressed air continues to be discharged from the first piping P1 for a predetermined period of time even after the simultaneous supply of the compressed air to all the pipings has been stopped, thus allowing the compressed air to be discharged from the first auxiliary jet nozzle N1. The second pit 11 further extends in the circumferential direction in fluid communication with both the simultaneous air supply pit 9*a* and the first pit 10 so that the compressed air can be supplied to the second piping P2 even after the supply to the first piping P1 has been discontinued. Furthermore, the third and fourth pits 12, 13 are arranged in a manner similar to the first and second pits so that the compressed air can be supplied successively to the third and fourth pipings P3 and P4 in phase-overlapped relation (see FIG. 6).

The air distributing pit 9*b* is connected with fifth to eighth pits or grooves 14~17 provided in the cylindrical surface of the valve spool 8B in the same manner as the first to fourth pits 10~13, therefore, and the compressed air also can be supplied successively to the fifth to eighth pipings P5~P8 as the valve spool 8B rotates.

The valve apparatus for supplying the compressed air constructed in accordance with the teachings of this invention operates as follows:

In FIG. 6, a period of time, during which the weft insertion is effected, is shown on the abscissa X, and intervals of the auxiliary jet nozzles N1~N8 are shown on the ordinate T.

Briefly, when the operation of the loom starts, the compressed air is supplied from the supply of air through the piping P into the chamber F. Then, the weft thread is transported into the shed by the high pressure air discharged from the main jet nozzle 3. In synchronism with the advancement of the weft through the shed, the rotating valve spools 8A, 8B allow the compressed air within the chamber F to be discharged successively from the auxiliary jet nozzles N1~N8 through the pits 9*a*, 9*b* and 10~17.

More specifically, when the weft inserting operation commences and therefore the weft thread begins to be transported into the shed by the jet of compressed air from the main nozzle 3, the simultaneous air supply pits 9*a*, 9*b* of the rotating valve spools 8A, 8B reach the upper portion of the chamber F to come into fluid communication with the first to eighth pipings P1~P8, whereby the compressed air within the air chamber F is supplied simultaneously through the corresponding pipings P1~P8 to the auxiliary jet nozzles N1~N8, thus providing a flow of pressure air along the overall length of the weft path within the shed. Then, as the weft inserting operation further progresses, the leading end of the weft passes near the first auxiliary jet nozzle N1 and approaches the second auxiliary jet nozzle N2. At that time, although the valve spools 8A, 8B have rotated for an angle causing the simultaneous air supply pits 9*a*, 9*b* to be spaced away from the pipings P1~P8, the first and second pits 10, 11 are maintained in fluid communication with the pipings P1 and P2. Therefore, the compressed air discharged from the first and second auxiliary jet nozzles N1 and N2 assists the leading end of the weft in being transported near the second auxiliary jet nozzle N2. The supply to the third to eighth jet nozzles N3~N8 is inoperative.

Then, immediately before the weft thread reaches the third auxiliary jet nozzle N3, the valve spool 8A is brought into a condition that the third air supply pit 12 is in fluid communication with the third piping P3, allowing N3 to assist the weft in being transported toward the forth jet nozzle N4. Thereafter, the compressed air is successively discharged from the fifth to eighth jet nozzles N5~N8 in the same manner as above described. Thus, the weft can be transported through the shed smoothly while being assisted by the jets successively discharged from the fifth to eighth jet nozzles N5~N8.

In addition, it is seen from FIG. 6 that a period of time, during which the compressed air is discharged from the compressed air to be discharged from the third jet nozzle the last jet nozzle N8, is prolonged in order to provide a certain tension in the weft until it is beaten up.

As explained above, in the arrangement of the first embodiment, the valve spools 8A, 8B driven in synchronism with the weaving motion of the loom are provided with the air supply pits 9*a*, 9*b* simultaneously supplying the compressed air to all the first to eighth auxiliary jet nozzles N1~N8 at the beginning of the weft inserting operation, and with first to eighth pits 10~17 allowing the jets of compressed air to be discharged successively from the auxiliary jet nozzles N1~N8 during the weft inserting operation so that a certain overlap occurs between each two successive jets. Therefore, at the beginning of the weft inserting operation, the flow of compressed air can be produced along the overall length of the shed. This causes the weft thread launched by the main jet nozzle to be transported smoothly through the shed. In this respect, it is to be noted that, where the auxiliary jet nozzles N1~N8 are operated successively during the normal weft inserting operation without the simultaneous air supply from all the jet nozzles N1~N8 at the beginning of the weft inserting operation, vortexes will occur locally in the flow of compressed air from each auxiliary jet nozzle, which vortexes prevent a smooth weft insertion. However, in this embodiment of the invention, the flow of air is first established along the overall length of the shed to provide a minimum amount of turbulence, resulting in a most favourable weft insertion operation being carried out.

Especially, even when the loom is in one picking motion or operated at a low speed (at that time the auxiliary jet nozzles operated in synchronism with the weaving motion of the loom are delayed in injection timing relative to the advancement of the leading end of the weft) such, for example, as during the preparatory operation immediately after the looming, when it is necessary to re-insert a new weft after a weft breakage, when it is necessary to observe an inserting condition of the new weft before the normal operation is again commenced, when it is necessary to confirm the position of the cloth fell upon occurrence of trouble, and when it is necessary to observe a condition by giving one picking motion to the loom, the weft insertion operation can be accomplished without error because the flow of air is established along the overall length of the weft path in the shed at the beginning of the weft inserting operation.

Figure 7:
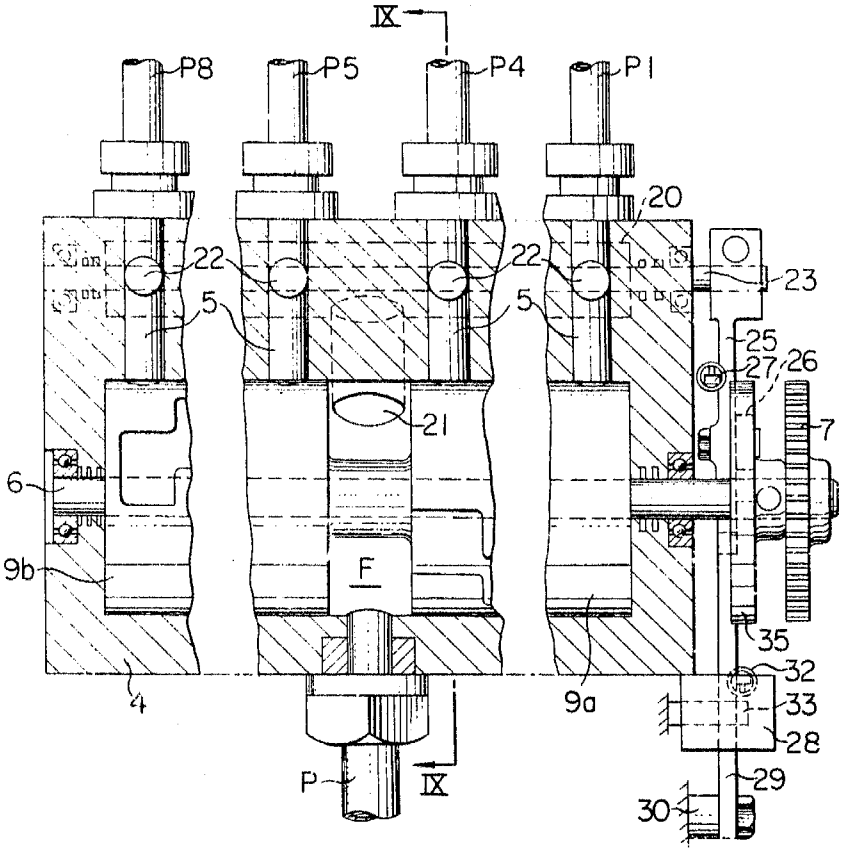
FIG. 7 is a longitudinal sectional view similar to FIG. 3, but showing a modification of the invention.

A second embodiment of this invention will be described hereinafter in conjunction with FIGS. 7 to 9.

The second embodiment is similar to the first embodiment shown in FIGS. 3 to 6, except that the simultaneous air supply pits 9*a*, 9*b* in the valve spools 8A, 8B are eliminated and an additional air supply mechanism is provided in the casing 4 for simultaneously causing all the auxiliary jet nozzles N1~N8 to be operative. In FIGS. 7 to 9, similar reference numerals to those in FIGS. 3 to 6 denote corresponding or similar parts.

Provided in the upper right-hand corner of the casing 4 is a substantially cylindrical air distributing chamber 20, which is in fluid communication with the chamber F through a single passage 21 and with the pipings P1~P8 through eight passages 22. A rotary spindle 23 extends through the distributing chamber 20 and the same is supported for rotation in a conventional manner as shown by dotted lines in FIG. 7. The spindle 23 is provided with eight sector members 24, which correspond in axial position to the eight passages 22 so as to simultaneously open and close the eight passages 22.

Fitted onto one end of the spindle 23 exterior of the casing 4 is an operating arm 25, at a substantially mid portion of which a cam follower 26 is provided. Between the end of the casing 4 and the operating arm 25, a biassing means (normally a coil spring 27) is spanned so as to bias the operating arm 25 in the clockwise direction in FIG. 8.

An electromagnetic solenoid 28 is mounted on the bottom of the casing 4 with a movable core 31 connected at the extremity thereof to the substantially mid portion of an operating lever 29 pivotably supported by a pin 30. The operating lever 29 is biassed in the clockwise direction by a coil spring 32 until it comes in contact with a stop 33. The free end of the operating lever 29 is in engagement with the arm 25 so as to maintain the arm 25 in a position shown by the solid line in FIG. 8 against the action of the coil spring 27. An electric switch 34 is disposed below the solenoid 28.

A cam plate 35 is fixed onto the spindle 6 at a position near the gear 7, its posirion being adjustable by adjusting set bolts 36. Under a condition that the cam surface 35*a* of the cam 35 contacts against the cam follower 26, the sector members 24 mounted on the rotary spindle 23 close the corresponding passages 22, whereas under a condition that the cam surface 35*b* contacts with the cam follower 26, the sector members 24 open the passages 22. Also, it is to be noted that a point of time, at which the sector members 24 open the passages 22 to supply the compressed air simultaneously to all the auxiliary jet nozzles N1~N8, is the same as that of the first embodiment, i.e., a point of time at which the main jet nozzle 3 begins to launch the compressed air.

Figure 8:
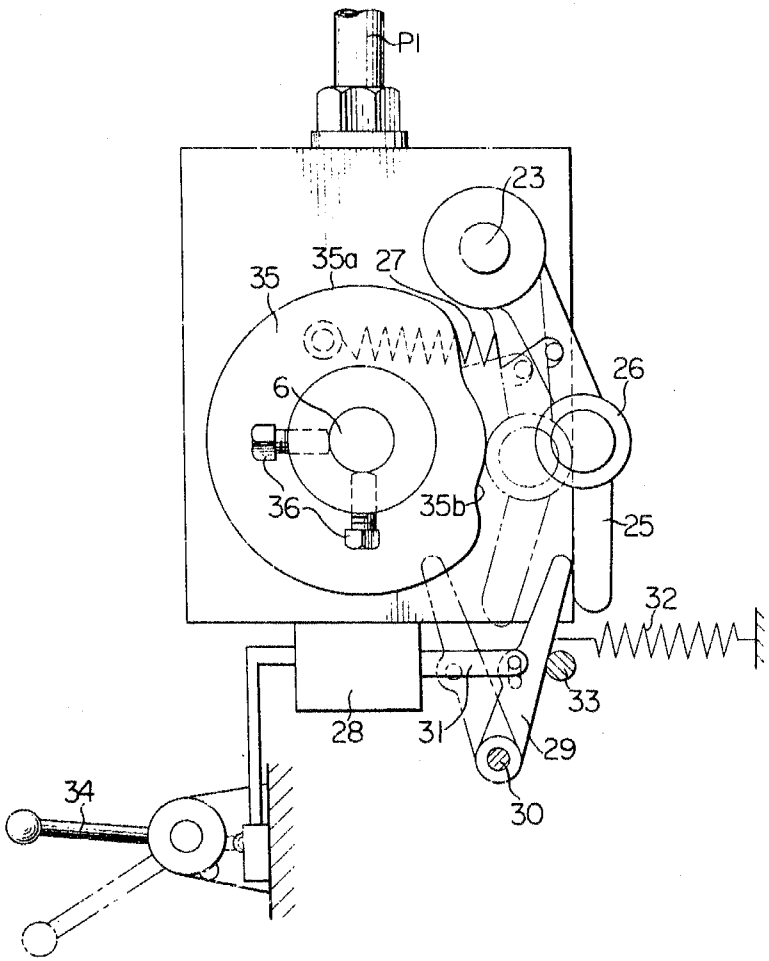
FIG. 8 is an end view of the apparatus shown in FIG. 7.
Figure 9:
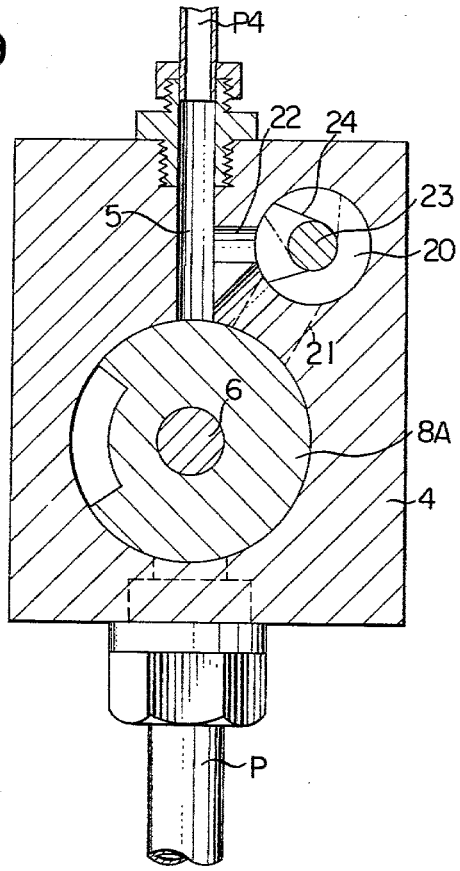
FIG. 9 is a cross section taken on the line IX—IX of FIG. 7.

With respect to the second embodiment, during the normal operation of the loom wherein the auxiliary jet nozzles N1~N8 successively operate in time with the main jet nozzle 3, i.e., the advancement of the weft leading end, the arm 25 is maintained in the position shown by the solid line in FIG. 8 to thereby prevent the simultaneous air injection of the auxiliary jet nozzles N1~N8. However, when the rotary spindle 6 rotates, the first to eighth air supply pits 10~17 are successively brought into fluid communication with the auxiliary jet nozzles N1~N8 to inject the jets successively, resulting in a smooth weft insertion operation.

When the loom is operated at a low speed or it is necessary to give one picking motion to the loom, the injection timing of the auxiliary jet nozzles N1~N8 is delayed with respect to the advancement of the weft leading end through the shed. At that time, the electromagnetic solenoid 28 is energized preliminarily by operating the switch 34 to move the movable core 31 in the left-hand direction in FIG. 8, whereby the operating lever 29 is rotated in the counterclockwise direction against the action of the spring 32. This allows the operating arm 25 to rotate in the clockwise direction about the spindle 23 and allows the cam follower 26 to come into contact with the cam surfaces 35*a* or 35*b* of the cam 35.

Then, upon operation of the loom, the jet of compressed air is discharged from the main jet nozzle 3 to transport the weft into the shed and the auxiliary jet nozzles N1~N8 are successively operated when the valve spools 8A, 8B rotate in time with the injection of the main jet nozzle 3. In the meantime, for each complete rotation of the cam 35, the cam follower 26 is pushed by the cam simultaneously with the commencement of the weft insertion operation, thereby causing the passages 22 to be opened through the operating arm 25 and the rotary spindle 23 by the eight sector members 24. Thus, the compressed air is discharged simultaneously from all the auxiliary jet nozzles N1~N8 at the beginning of the weft insertion operation, with the result that the weft insertion can be carried out by the same sure method as the first embodiment.

When the loom attains the normal operating condition, the switch 34 is off to deenergize the electromagnetic solenoid 28, whereby the operating lever 29, arm 25 and cam follower 26 are restored to the positions shown by the solid lines in FIG. 8 and the sector members 24 close the passages 22. Thus, the simultaneous air injection from the auxiliary jet nozzles N1~N8 is prevented.

It is understood from the foregoing that in the second embodiment there is provided, in addition to the valve bodies 8A and 8B, the air supply mechanism capable of operating all the auxiliary jet nozzles at the same time, so that it is possible to use this air supply mechanism only when necessary, for example, during the preparatory operation immediately after looming. This requires less total consumption of compressed air and electric power than required for the first embodiment.

Although specific embodiments have been described above, it will be readily understood by those skilled in the art that various rearrangements of parts and modifications of parts may be accomplished without departing from the spirit and scope of the invention as defined in the appended claims.

Figure 10:
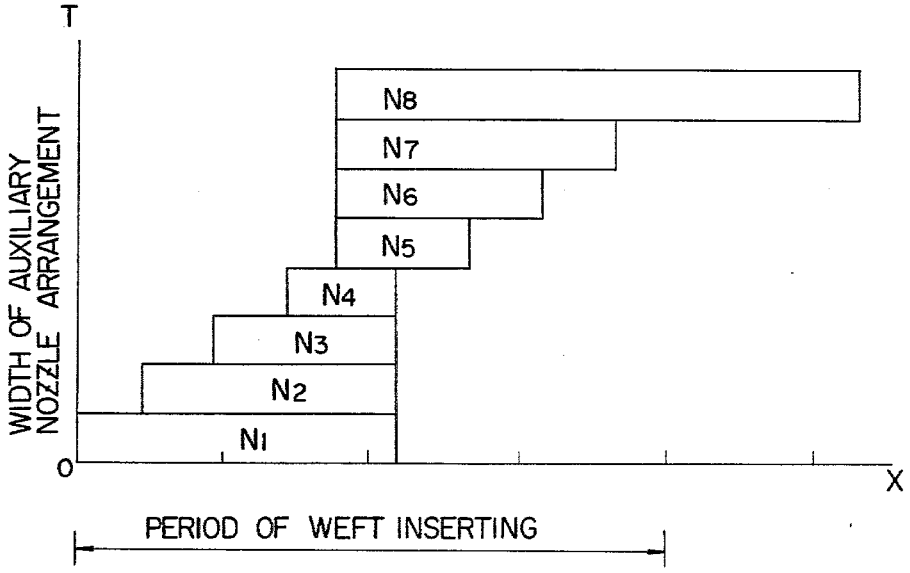
FIG. 10 is a diagram explaining a modified timing of the operation of auxiliary jet nozzles.

For example, although the simultaneous air supply pits 9*a* and 9*b* of the first embodiment are operative at the beginning of the weft inserting operation, the circumferential position of the air supply pits 9*a* and 9*b* may lie between the first to eighth air supply pits 10~17. In this case, all the auxiliary jet nozzles N1~N8 are operated simultaneously in the course of the weft insertion operation (see FIG. 10).

Two or more concave cam surfaces 35*b* may be provided on the cam 35 so that two or more simultaneous air injections from the auxiliary jet nozzles N1~N8 occur during one weft inserting operation.

Although in the illustrated embodiments an air supply pit is provided for each auxiliary jet nozzle, it may be possible to employ a single air supply pit which supplies the compressed air through several passages to several auxiliary jet nozzles.

In the second embodiment, the air supply mechanism for causing all the auxiliary jet nozzles to simultaneously discharge air is energized by the hand operated switch 34 when necessary. However, the air supply mechanism may be constructed with a timer as well as the switch so that it is operative for a predetermined period of time at the beginning of the weaving motion.

I claim:

1. A method for inserting a weft thread through a shed of a jet loom, said method comprising:

launching a weft thread by a fluid jet from a main jet nozzle, and thereby initiating insertion of said weft thread through a shed;

successively and sequentially discharging fluid jets from auxiliary jet nozzles spaced along the path of said weft thread through said shed, and thereby assisting said main jet nozzle in inserting said weft thread through said shed; and at least once during the period of time necessary to complete a weft thread insertion operation, simultaneously discharging fluid jets from all of said auxiliary jet nozzles.

2. A method as claimed in claim 1, comprising continuing said step of simultaneously discharging for a predetermined period of time at the beginning of said weft thread insertion operation.

3. A method as claimed in claim 1, comprising conducting said step of simultaneously discharging during the insertion of said weft thread through said shed.

4. An apparatus for inserting a weft thread through a shed of a jet loom, said apparatus comprising:

main jet nozzle means, adapted to be positioned adjacent an inlet of a shed of a jet loom, for emitting a fluid jet for launching a weft thread, and for thereby initiating insertion of said weft thread through said shed;

a plurality of auxiliary jet nozzles adapted to be spaced along the path of said weft thread through said shed;

first fluid supply means, connected to said axuiliary jet nozzles, for successively and sequentially discharging fluid jets from said auxiliary jet nozzles and for thereby assisting said main jet nozzle means in inserting said weft thread through said shed; and second fluid supply means, connected to said auxiliary jet nozzles, for simultaneously discharging fluid jets from all of said auxiliary jet nozzles.

5. An apparatus as claimed in claim 4, further comprising switch means for selectively bringing said second fluid supply means into operative and inoperative positions thereof.

6. An apparatus as claimed in claim 4, further comprising a valve casing, and cylindrical valve spools sealingly and rotatably disposed within said valve casing and defining therewith a fluid chamber adapted to be connected to a fluid source, said auxiliary jet nozzles being connected through said valve casing to the interior thereof, wherein said first fluid supply means comprises a plurality of circumferentially and axially staggered grooves formed in the exterior surfaces of said valve spools at positions to be successively and sequentially brought into communication with respective of said auxiliary jet nozzles during rotation of said valve spools.

7. An apparatus as claimed in claim 6, wherein said second fluid supply means comprises axially extending grooves formed in said exterior surfaces of said valve spools at positions to be brought into simultaneous communication with all of said auxiliary jet nozzles by rotation of said valve spools.

8. An apparatus as claimed in claim 6, wherein said second fluid supply means comprises a distributing chamber within said valve casing and extending in a direction parallel to the axes of said valve spools, said distributing chamber being in communication with said fluid chamber and with said auxiliary jet nozzles, means positioned within said distributing chamber for, upon rotation of said valve spools, opening and closing simultaneous communication from said fluid chamber, through said distributing chamber, to all of said auxiliary jet nozzles, and means for selectively bringing said opening and closing means into operative and inoperative positions thereof.

* * * * *